US007381120B2

(12) United States Patent
Henry

(10) Patent No.: US 7,381,120 B2
(45) Date of Patent: Jun. 3, 2008

(54) KNIFE SHARPENER

(75) Inventor: Mark James Henry, West End (AU)

(73) Assignee: Furitechnics Group Pty Ltd., Brisbane, Queensland (AU)

( * ) Notice: Subject to any disclaimer, the term of this patent is extended or adjusted under 35 U.S.C. 154(b) by 0 days.

(21) Appl. No.: 11/334,881

(22) Filed: Jan. 18, 2006

(65) Prior Publication Data

US 2007/0167122 A1 Jul. 19, 2007

(51) Int. Cl.
*B24B 19/00* (2006.01)

(52) U.S. Cl. ..... 451/439; 451/451; 451/523

(58) Field of Classification Search ..... 451/439, 451/451, 523

See application file for complete search history.

(56) References Cited

U.S. PATENT DOCUMENTS 1,429,984 A * 9/1922 Vollmer ..... 76/86
2,432,535 A * 12/1947 McBride ..... 451/194
2,471,207 A * 5/1949 Freeman ..... 451/555
2,542,472 A * 2/1951 Brinkley ..... 76/86
2,559,273 A * 7/1951 Brinkley ..... 76/88
2,566,809 A * 9/1951 Risley et al. ..... 451/311
3,567,013 A 3/1971 Kovach
4,450,653 A * 5/1984 Fletcher ..... 451/552
4,719,722 A 1/1988 Washburn
4,751,795 A 6/1988 Jenne
5,440,953 A 8/1995 Gangelhoff et al.
5,458,534 A * 10/1995 Campione et al. ..... 451/555
5,477,753 A 12/1995 Branscum et al.
6,101,898 A * 8/2000 Gore et al. ..... 76/82
6,142,038 A * 11/2000 Kenesky et al. ..... 76/86
D481,285 S 10/2003 Moeller et al.
6,769,327 B2 * 8/2004 Henry ..... 76/86
6,881,137 B2 4/2005 Friel et al.

* cited by examiner

*Primary Examiner*—Maurina Rachuba
(74) *Attorney, Agent, or Firm*—Robert L. Epstein; Epstein Drangel Bazerman & James, LLP

(57) ABSTRACT

A knife sharpener comprising a sharpening device preferably of the type involving upwardly extending pairs of overlapping, resiliently flexible fingers or strips forming opposed abrasive sharpening faces, provided with a pair of shields respectively operative between closed positions in which they cover and protecting the sharpening device and open positions in which they respectively provide a handhold for the device and protect the hand of the user when it is on the handhold, and preferably provided with locking means moveable between a first position engaging said shields and retaining them in said closed position and a second position releasing said shields from their closed positions and extending out from said assembly to provide protection for the hand of the user.

23 Claims, 6 Drawing Sheets

Fig. 8
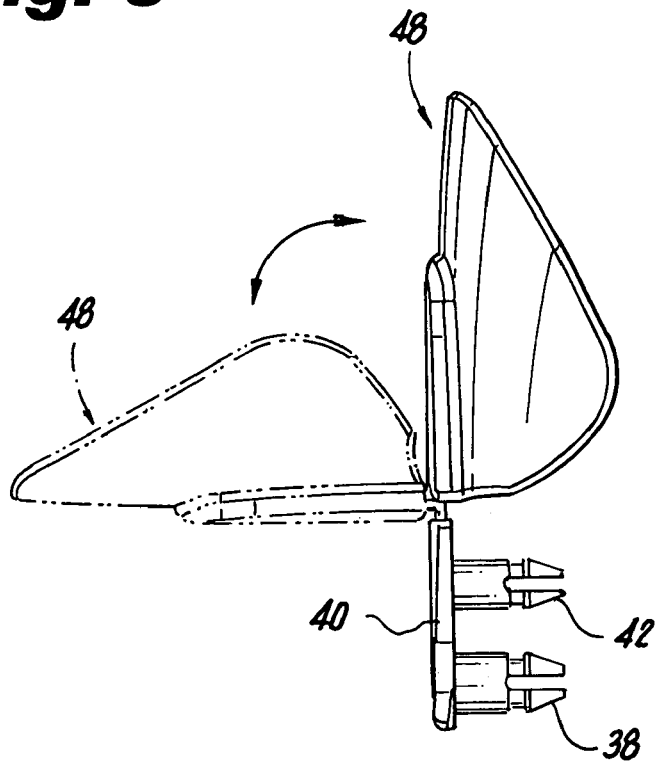
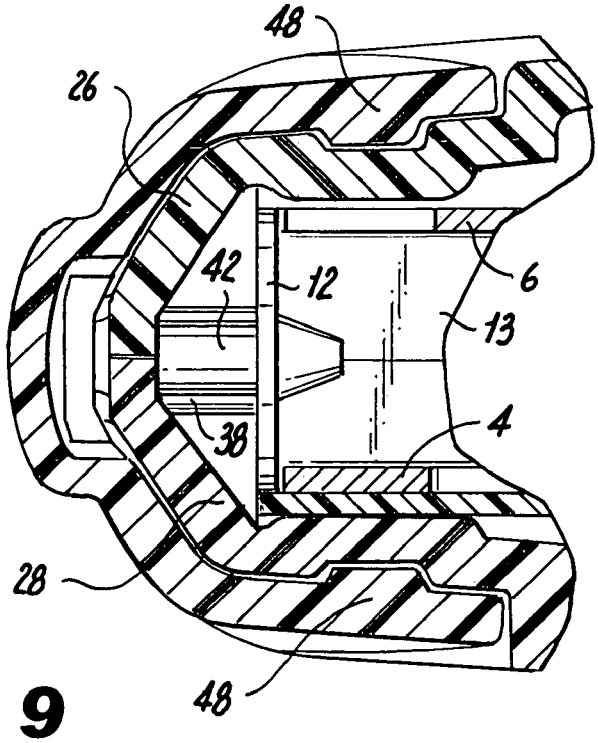
Fig. 9

Fig. 10
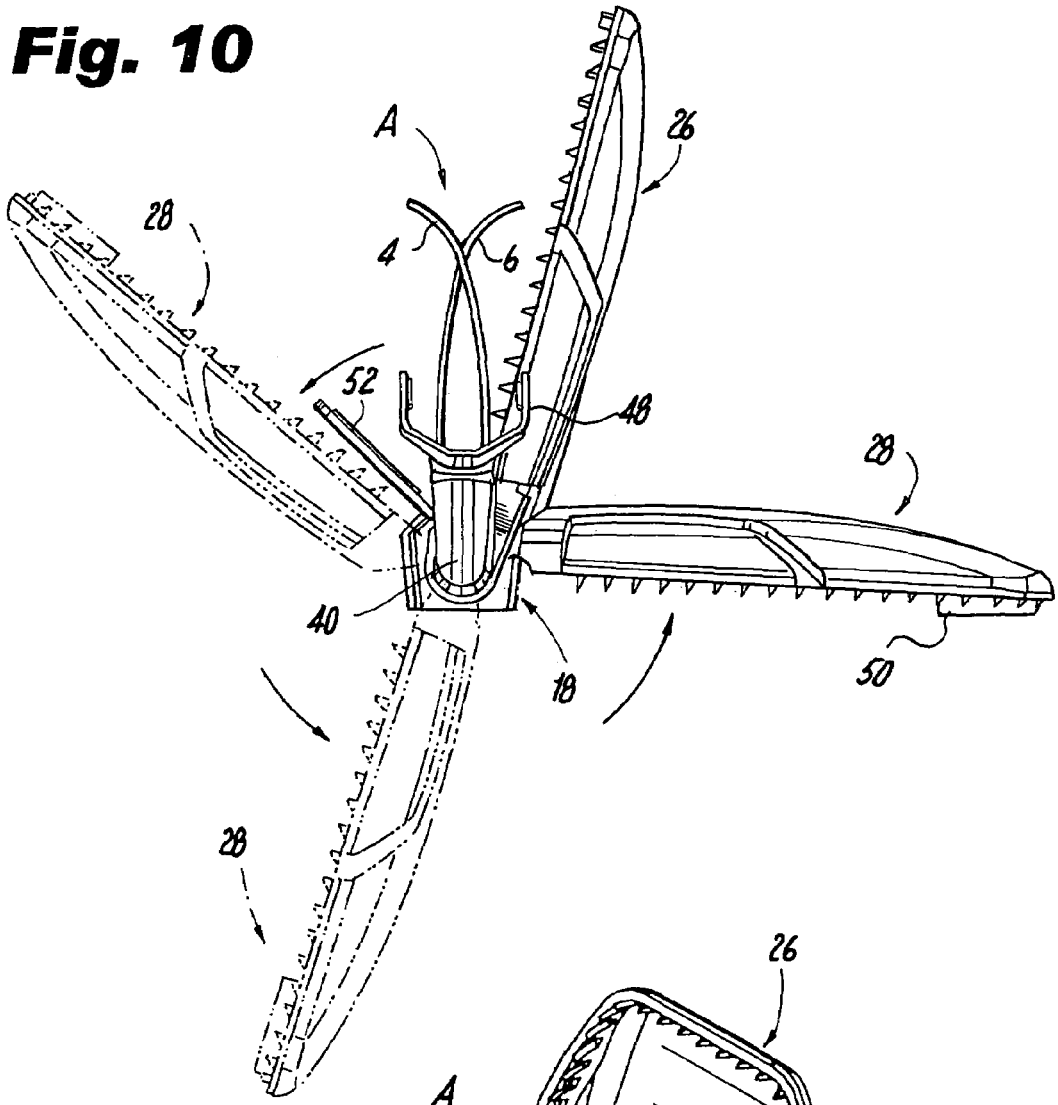
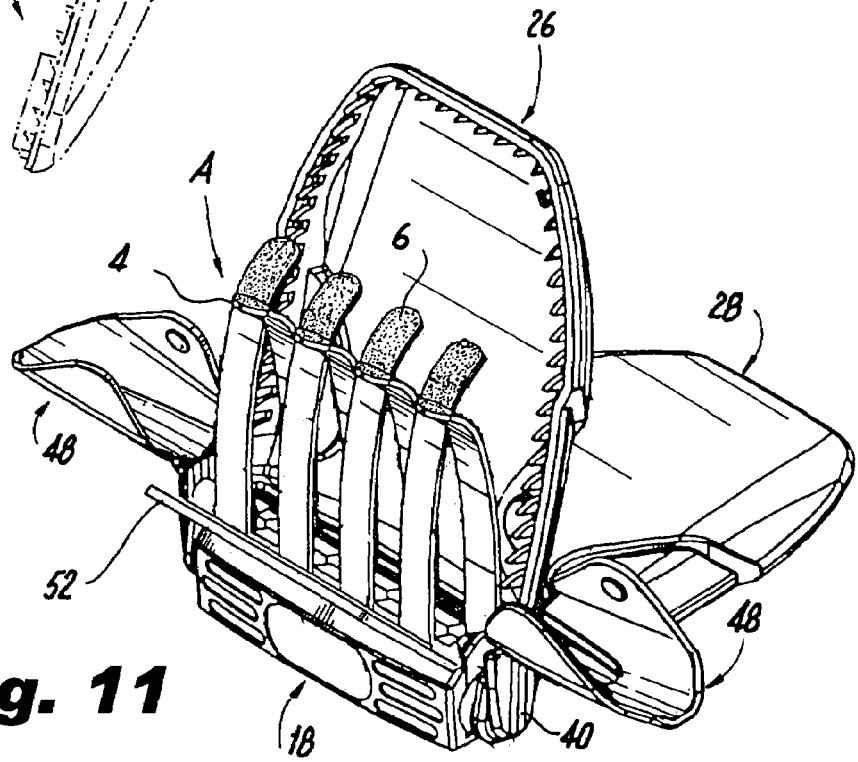
Fig. 11

KNIFE SHARPENER

BACKGROUND OF THE INVENTION

Many devices have been proposed for sharpening knives. One type of such device, suitable for both professional and home use, includes a structure through and across which a knife may be drawn, the device then acting on the cutting edge of the device to enhance the sharpness of that edge. Such sharpeners, when not secured to some external support, must be held in place on a horizontal support such as a table by one hand of the user, the other hand of the user manipulating the knife. The proximity of the knife, as it is drawn through the sharpening device, to the user's hand engaged in holding the device stationary on a support surface presents significant danger of injury to that hand if the knife is not manipulated in an entirely correct fashion, and hence it is highly desirable to provide the device with some means for protecting the user's holding hand.

One particularly effective sharpening device is that shown in the inventor's prior U.S. Pat. No. 6,769,327 of Aug. 3, 2004 entitled "Knife and Blade Sharpener". The knife sharpener there disclosed has sets of overlapping resiliently flexible fingers or strips which form opposed abrasive sharpening faces operable to engage the cutting edge of the knife blade. Sharpeners of that type have proved to be exceptionally effective, but those resiliently flexible fingers, if exposed to the vicissitudes of handling and storage, are susceptible to physical damage or distortion. In addition, the marketplace places a high value on compactness for easy handling and storage. Also, since the fingers are abrasive the environment should be shielded from possible damage from the fingers themselves. Moreover, it has been found that the conventional hand-guard, usually only co-extensive with the abrasive finger assembly, does not provide adequate protection to the user's hand, particularly the thumb-portion of that hand.

SUMMARY OF THE INVENTION

The object of the present invention is to provide a knife sharpening device preferably but not exclusively of the type involving pairs of overlapping, resiliently flexible abrasive fingers or strips, in which the knife-sharpening device is protected from deterioration, damage or abuse while being stored, in which the sharpening elements are housed to prevent damage to the environment, and which provides enhanced protection to the hand of the user when the sharpener is to be operatively employed. The arrangement of parts which accomplishes those objectives are particularly adapted for use with a knife sharpener with resiliently flexible abrasive fingers or strips of the aforementioned U.S. Pat. No. 6,769,327, but is not necessarily limited thereto.

More specifically, the sharpener device of whatever type is designed to be placed upon a supporting surface when it is used, and to be retained by one hand of the user, the other hand of the user drawing the knife through the sharpening device in known fashion. Secured to the device are a pair of multi-function shields. When in one condition suitable for storage those shields encompass the sharpening device and protect it from adverse influences. When the sharpener is to be used a first of those shields is moved from its closed position to a hand held position extending out at approximately right angles to the sharpening device, there to be there pressed against a supporting surface and held by one hand of the user. The second shield is interposed between the sharpening device and the handhold shield, preferably moving somewhat from its closed position to its open h position in which it protects the user's hand. The two shields are retained in their closed position by a pair of locking members moveably mounted on the structure between a first position engaging the shields and retaining them in their closed position and a second position releasing the shields for movement to their open positions and also preferably extending out from the edges of the sharpening device to provide additional protection to the user's hand, and particularly the thumb-portion of that hand. The base of the structure may also carry a flap which, when the shields are in their open positions, extends out from said base to further protect the user's hand.

The parts of the device are readily manufactured and assembled with a minimum of precision required, with the wing-like shield locking means, when assembled with the other parts, providing the structure for articulately mounting the shields.

BRIEF DESCRIPTION OF THE DRAWINGS

The accomplishments of the above, and to such other objectives as may hereinafter appear, the preferred embodiment of the present invention will now be described with reference to the accompanying drawings, in which:

FIG. 8 is a side elevational view of one of the locking members which retain the shields in closed position'

FIG. 9 is a fragmentary cross-sectional view of one end of the sharpener in closed position taken along the line 9-9 of FIG. 2;

FIG. 10 is an end elevational view of the sharpener in open position ready to be grasped by the user;

FIG. 11 is a three-quarter perspective view of the sharpener of FIG. 10.

DETAILED DESCRIPTION OF THE PREFERRED EMBODIMENT

Figure 1:
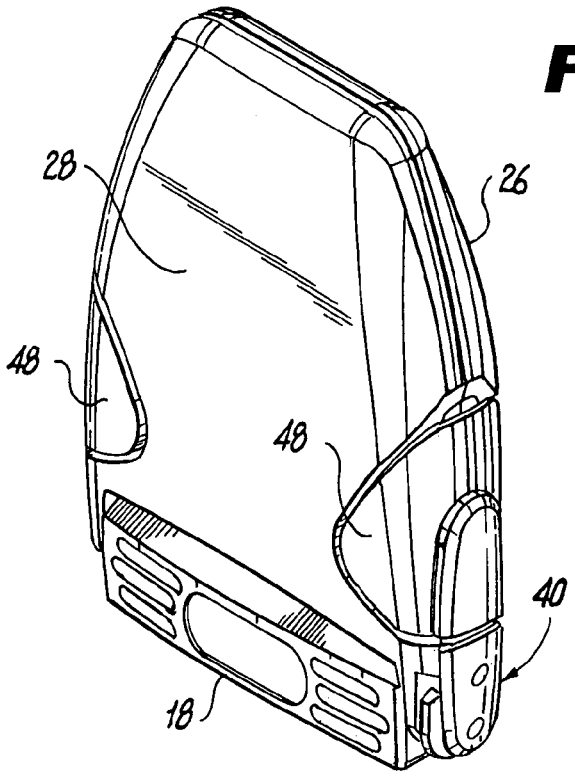
FIG. 1 is a three-quarter perspective view of the sharpener of the present invention in closed condition.

The knife sharpener device per se may be of the general type shown in U.S. Pat. No. 6,769,327. In its specific form here it is of the form of a finger assembly generally designated A, which comprises an elongated narrow bottom wall 2 from which resilient staggered sets of curved fingers 4 and 6 respectively extend upwardly, the fingers 4 at their upper extremities entering into the spaces between the fingers 6 and vice versa, the outwardly facing surfaces 4A and 6A of the fingers 4 and 6 being appropriately abrasive in nature, all as described in the aforementioned '327 patent. The finger assembly A is mounted on a base generally designated 8 comprising an elongated bottom wall 10 and upstanding side walls 12, the latter being provided with two sets of matching apertures 14 and 16 respectively. Both the finger assembly 2, 4 6 and the base 8 may be formed of metal and finger assembly A may be secured to the base 8 in any appropriate manner, as by spot welding.

The assembled finger assembly A with attached base 8 may, if desired, be received in a base receptacle generally designated 18, that receptacle being made of rubber or other plastic and having side walls 20 and 22 between which the finger assembly may be received, with inwardly directed projections 24 snapping within the spaces between the fingers 4 and the fingers 6 respectively. The base receptacle provides the sharpener unit with a frictional bottom surface which will grip the surface on which the unit is mounted when in use and the projections 24 help to retain the base receptacle 18 in position relative to the finger assembly A and to dampen vibration of the fingers.

The sharpener as here disclosed is provided with a pair of elongated shields 26 and 28, one disposed on each side of the finger assembly A and extending thereover so as collectively to enclose and protect the fingers 4 and 6 when those shields 26 and 28 are in their closed position, with the shield 26 on one side of the finger assembly and the shield 28 on the other side thereof. This can best be seen in FIGS. 1-3

The shield 26 is provided with downwardly extending ears 30 provided with apertures 32, and the shield 28 is provided with downwardly extending ears 34 provided with apertures 36. The shields 26 and 28 are articulately mounted on the base 8 by bringing the ear apertures 32 and the ear apertures 36 into registration with the apertures 14 in the upstanding walls 12 on the base 8 and by retaining them in that position with desired freedom of rotational movement by means of prongs 38 on side pieces 40, those prongs penetrating the apertures 14, 32 and 36. The prongs 38 are so designed that after they have passed through those apertures they will expand on the inside of the base walls 12, thus holding the parts together. The side pieces 40 are provided with second prongs 42 which similarly pass through and lock behind the apertures 16 in the base walls 12, the shield ears 30 and 34 having cut out portions 44 and 46 respectively to accommodate the prongs 42 when the shields 26 are in their upright and closed position.

Pivotally secured to the upper edges of the side pieces 40 are locking members in the form of curved wings 48 movable between essentially vertical positions in which they encompass the shields 26 and 28 when the latter are in their closed upright position and retain them in that position, and substantially horizontal positions, as shown in FIGS. 10 and 11, thereby releasing the shields 26 and 28 from their upright closed position and permitting them to move to their operative positions as described below. Moreover, as can be seen from FIGS. 10 and 11 the wings 48 when in their shield-releasing position, are essentially horizontal and extend out beyond the edges of the overall assembly.

Figure 2:
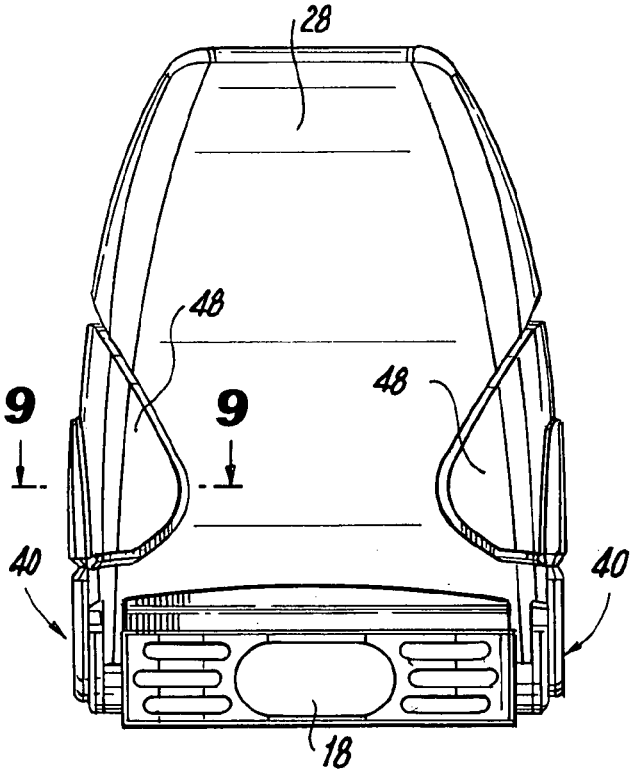
FIG. 2 is a front elevational view thereof.
Figure 3:
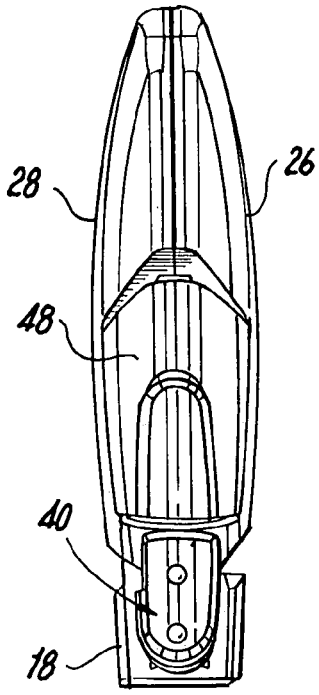
FIG. 3 is an end elevational view thereof.
Figure 4:
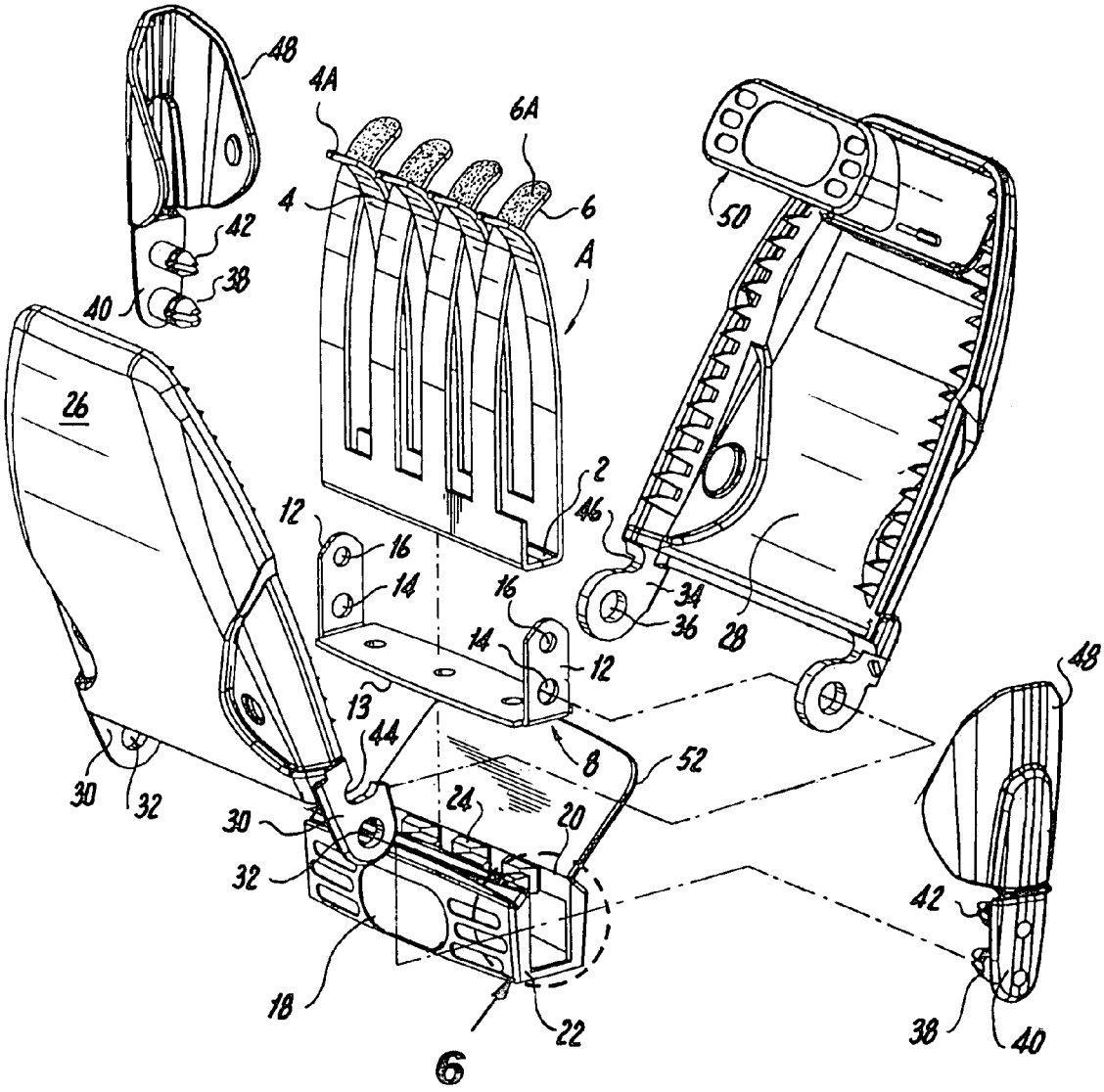
FIG. 4 is an exploded view thereof.
Figure 5:
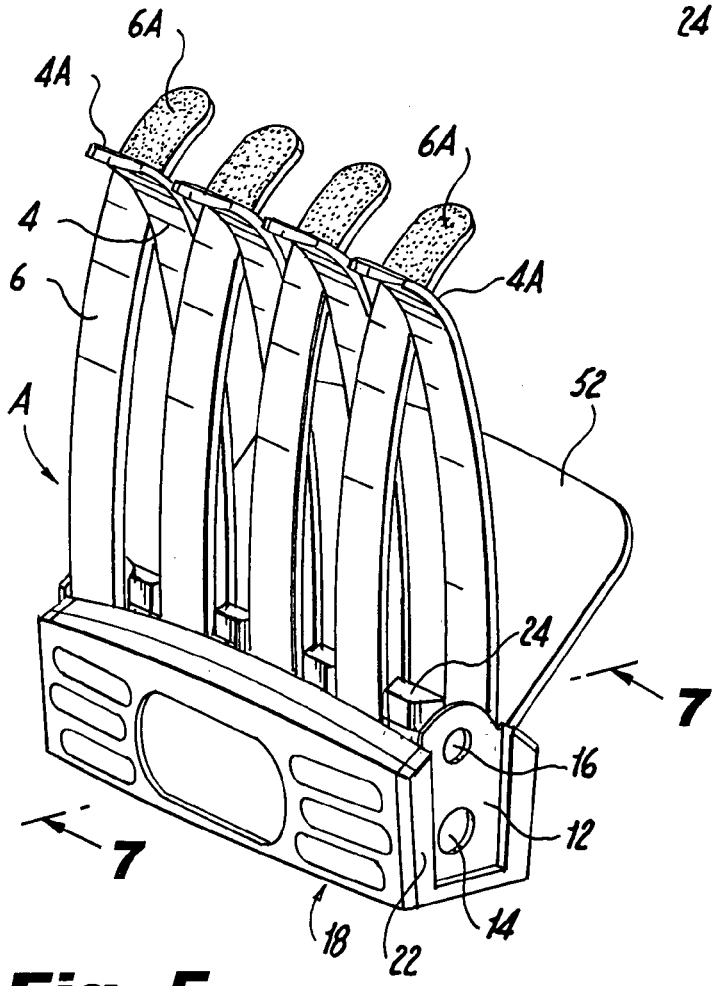
FIG. 5 is a perspective view of the abrasive fingers assembled with the sharpener base.
Figure 6:
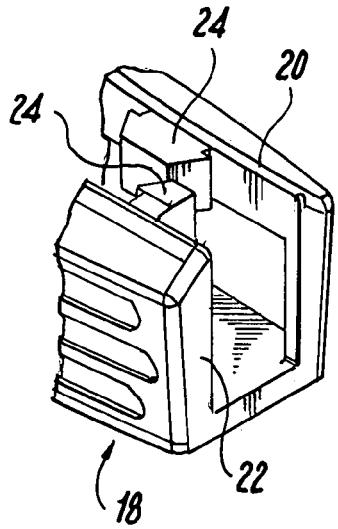
FIG. 6 is a detailed perspective view of the end of the base receptacle.
Figure 7:
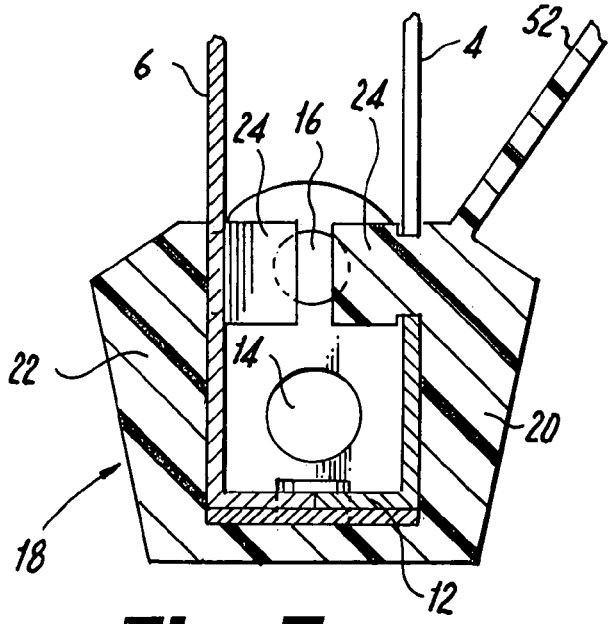
FIG. 7 is a cross-sectional view taken along the line 7-7 of FIG. 5.

When the sharpener is not in use, as shown in FIGS. 1-3, its shields 26 and 28 are retained in closed position by the wings 48, thereby to protect the finger assembly A from deleterious external damage-causing influences and protecting the environment from damage emanating from the fingers, while at the same time giving to the overall structure a visual impression of solidity.

Figure 12:
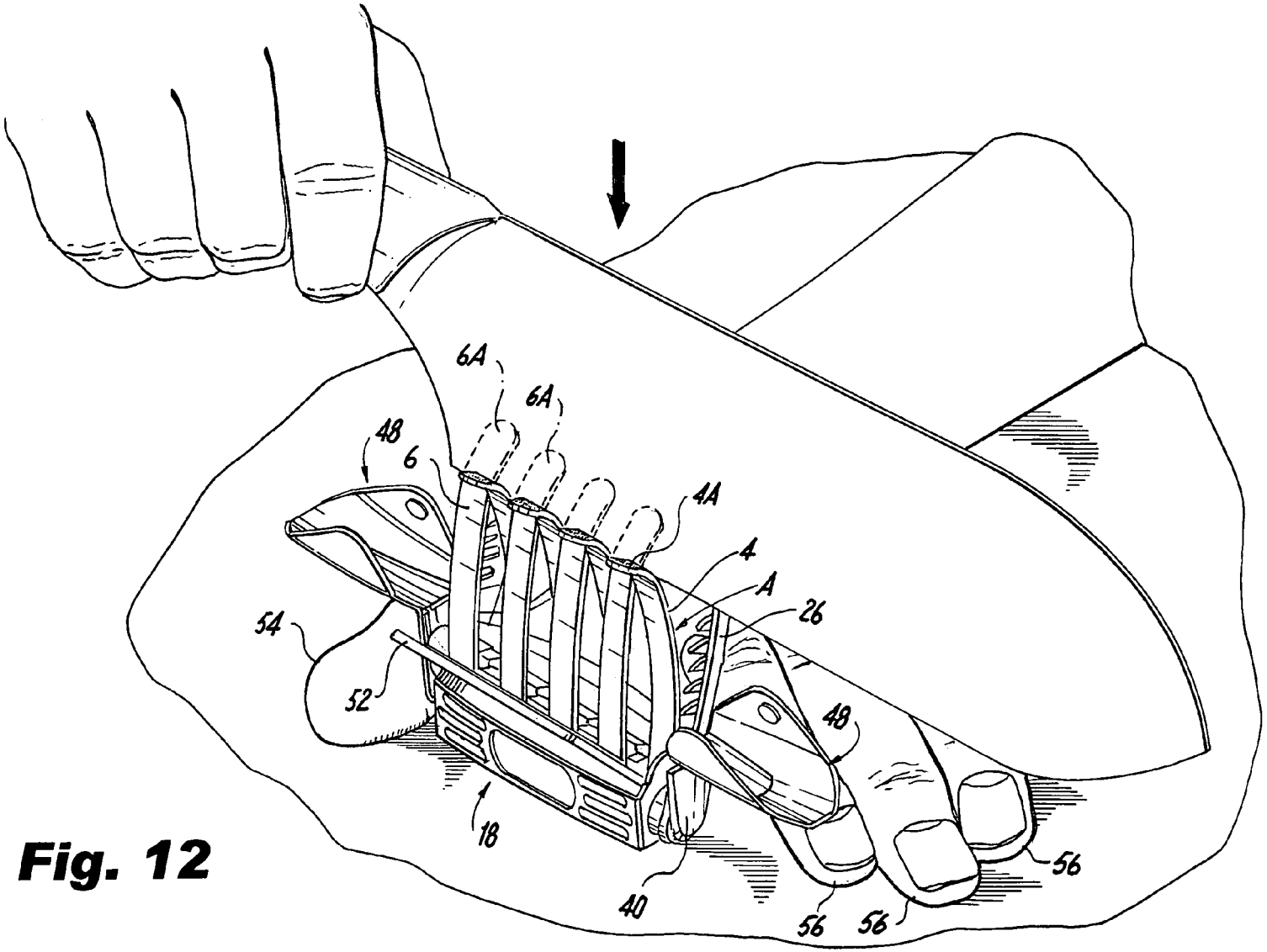
FIG. 12 is a three-quarter view of the sharpener in use.

When the sharpener is to be used for its designed purpose, the wings 48 are moved to their outer positions, as shown in FIGS. 10 and 11, thus releasing the shields 26 and 28. The shield 28, originally on one side of the finger assembly A, is pivoted about the prongs 42 over an arc somewhat in excess of 270°, as indicated by the arrows and broken lines in FIG. 10, so as to extend substantially horizontally from the base 18, but being located on the same side of the finger assembly A as the shield 26 (see FIG. 11). It therefore can then function as a handhold for the sharpener when it is placed on a supporting surface, as shown in FIG. 12. It may be provided on its inner surface, then oriented downwardly toward the supporting surface, with a surface-engaging pad 50 of rubber, plastic or the like. The shield 26, on the same side of the assembly as the now extended handheld shield 28, may, if desired, be permitted outward pivotal movement to a slight degree (perhaps 10-15°), so as to partially overlie the extended handhold shield 28. With or without such small degree of movement the shield 26 is interposed between the user's hand on the handheld shield 28 and the knife as it is drawn through the fingers 4 and 6, thus in this condition functioning as a hand protecting safety feature. Such protection is limited to the width of the shield 26, while the user's hand when on handhold shield 28 extends beyond that width. However, when the wings 48 are folded out, as they must be to enable the shields 26 and 28 to play their part, they extend out beyond the end edges of the assembly, and thus provide further protection for the user's hand, and particularly the thumb area of the hand, as shown in FIG. 12, where the user's thumb is designated 34 and his other fingers are designated 56.

As an additional safety feature, the base receptacle 18 may be provided with an articulately mounted flap 52 which, when the sharpener is to be used, extends out beyond the base receptacle 18 so as to protect the user's hand from gross misdirection of the knife being sharpened. When the sharpener is to be stored the shield 26, in moving to its closed position, engages the flap 52 and moves it to a vertical stowed position.

Once the device has been set up for use, as described above, the blade of the knife to be sharpened is placed between the upwardly extending portions of the fingers 4 and 6, the blade is held vertically and it is pulled down and back through the fingers with pressure. This action is repeated until the proper edge is produced on the knife. When proper sharpening has been effected the shields 26 and 28 are returned to their closed position, the wings 48 are swung up to retain the shields in their closed position, and the unit may then be handled with minimal care, since the sharpening members, here shown as abrasive fingers 4 and 6, are enclosed and protected and the environment is likewise protected from damage emanating from the fingers themselves.

It will be apparent that many variations may be made in the details of the various parts, all without departing from the spirit of the invention as defined in the following claims:

I claim:

1. A knife sharpener comprising a set of upwardly extending fingers resiliently flexible against the force of the knife between which a knife blade may be drawn for sharpening purposes, said set having a base on which said set is mounted with said fingers in essentially vertical position, first and second shields operatively connected to said base, said first shield having a vertical position substantially covering and extending up alongside one side of said vertical set of fingers, said second shield articulately mounted on said base to be moveable between a closed vertical position substantially covering and extending up alongside the other side of said set of fingers and an open position extending out to said one side of said set of fingers and there functioning as a hand-rest for said sharpener.

2. The knife sharpener of claim 1, in which the shields are elongated sea-shell-simulating elements.

3. The knife sharpener of claim 1, in which said first shield is articulately mounted on said base to be moveable between said vertical position substantially covering said one side of said set of fingers and an open position outwardly located from said vertical position.

4. In the knife sharpener of either of claims 1 or 3, locking means operatively connected to said base and articulately mounted thereon to be moveable between a first position engaging said shields when said shields are in vertical position and retaining them in that position and a second position releasing said shields.

5. A knife sharpener comprising a device across which a knife may be drawn for sharpening purposes, said device comprising a base for supporting said device on a supporting surface, means extending from said base engageable by the hand of the user to hold said base on said supporting surface, first hand-protecting means operatively connected to and extending from said base in a given direction to be interposed between said device and said hand-engageable means, and a second hand-protecting means operatively connected to said base and extending out beyond said first hand-protecting means to a position higher than said hand-engageable means and extending in a direction essentially at right angles to said given direction.

6. The knife sharpener of claim 5, in which said first hand-protecting means extends out from said base in one direction and said secondary hand-protecting means extends out from said base in a second and different direction.

7. The knife sharpener of claim 6, in which said first and second directions are essentially at right angles to one another.

8. The knife sharpener of claim 6, in which said device is such that a knife is drawn therethrough for sharpening purposes in a given direction, said first hand-protecting means extends from said base in a direction essentially at right angles to said given direction, and said second hand-protecting means extends from said base essentially in said given direction.

9. A knife sharpener comprising an upwardly extending device across which a knife may be drawn for sharpening purposes and including a base for supporting said device on a surface in an essentially vertical position in storage and use, first and second shields operatively connected to and extending normally upwardly from said base, said first shield being articulately mounted on said base to be moveable between a normal vertical closed position substantially covering one side of said device and an operative open position outwardly located from said one side, said second shield being articulately mounted on said base to be moveable between a normally vertical closed position essentially mating with said first shield and covering the other side of said device and an open position extending out from said base to said one side of said device and there functioning as a hand-rest for said device.

10. The knife sharpener of claim 9, in which said shields are elongated sea-shell-simulating elements.

11. In the knife sharpener of claim 9, locking means operatively connected to said base and articulately mounted thereon to be moveable between a first position engaging said shields when said shields are closed position and retaining them in that position and a second position releasing said shields.

12. The knife sharpener of claim 11, in which said locking means comprises a mounting portion fixedly secured to said base and a wing articulately connected to said mounting portion so as to be moveable between said first and second positions.

13. The knife sharpener of claim 11, in which there are a pair of said locking means, one at each edge of said device.

14. The knife sharpener of claim 13, in which said base has sides at which said shields are located and edges at which said locking means are located, said locking means having a part mounting said locking means on said base, at least one of said shields being mounted on said part.

15. The knife sharpener of claim 13, in which both of said shields are articulately mounted on said part.

16. The knife sharpener of claim 13, in which said mounting portion is secured to said base by a part protruding from said mounting portion, at least one of said shields being mounted on said part.

17. The knife sharpener of claim 16, in which both of said shields are mounted on said part.

18. A knife sharpener comprising a set of upwardly extending fingers between which a knife blade may be drawn for sharpening purposes, said set having a base on which said set is mounted, first and second shields operatively connected to said base, said first shield having a position substantially covering and extending up alongside one side of said set of fingers, said second shield articulately mounted on said base to be moveable between a closed position substantially covering and extending up alongside the other side of said set of fingers and an open position extending out to said one side of said set of fingers and there functioning as a hand-rest for said sharpener, locking means operatively connected to said base and articulately mounted thereon to be movable between a first position engaging said shields when said shields are in closed position and retaining them in that position and a second position releasing said shields, in which the locking means in its said second position extends out beyond the edge of said set of fingers, thereby to function as a protector for the user's hand on said hand-rest.

19. The knife sharpener of claim 18, in which there are a pair of said locking means, one at each edge of said set of fingers.

20. The knife sharpener of claim 19, in which said base has sides at which said shields are located and edges at which said locking means are located, said locking means having a part mounting said locking means on said base, at least one of said shields being mounted on said part.

21. The knife sharpener of claim 19, in which said locking means comprises a mounting portion fixedly secured to said base and a wing articulately connected to said mounting portion so as to be moveable between its said first and second positions.

22. The knife sharpener of claim 21, in which said mounting portion is secured to said base by a part protruding from said mounting portion, said shields being mounted on said part.

23. A knife sharpener comprising an upwardly extending device through which a knife may be drawn for sharpening purposes and including a base for supporting said device on a surface, first and second shields operatively connected to and extending upwardly from said base, said first shield being articulately mounted on said base to be movable between a closed position substantially covering one side of said device and an open position outwardly located from said one side, said second shield being articulately mounted on said base to be movable between a closed position essentially mating with said first shield and covering the other side of said device and an open position extending out from said base to said one side of said device and there functioning as a hand-rest for said device, locking means operatively connected said base and articulately mounted thereon to be movable between a first position engaging said shield when said shields are in closed position and mating them in that position and a second position releasing said shield, in which the locking means in its said second position extends out beyond the edge of said device, thereby to function as a protector for the user's hand when on said hand rest.

* * * * *